US009719523B2

(12) United States Patent
Jayaram et al.

(10) Patent No.: US 9,719,523 B2
(45) Date of Patent: Aug. 1, 2017

(54) APPARATUS, SYSTEM AND METHOD FOR PUMPING GASEOUS FLUID

(71) Applicant: Summit ESP, LLC, Tulsa, OK (US)

(72) Inventors: Shiv Jayaram, Houston, TX (US); Steven Keith Tetzlaff, Owasso, OK (US)

(73) Assignee: Summit ESP, LLC, Tulsa, OK (US)

( * ) Notice: Subject to any disclaimer, the term of this patent is extended or adjusted under 35 U.S.C. 154(b) by 70 days.

(21) Appl. No.: 14/602,650

(22) Filed: Jan. 22, 2015

(65) Prior Publication Data

US 2015/0152877 A1 Jun. 4, 2015

Related U.S. Application Data

(63) Continuation of application No. 13/801,969, filed on Mar. 13, 2013, now abandoned.

(Continued)

(51) Int. Cl.

*F04D 13/08* (2006.01)
*F04D 13/10* (2006.01)

(Continued)

(52) U.S. Cl.

CPC ..... *F04D 29/18* (2013.01); *F04D 1/00* (2013.01); *F04D 1/04* (2013.01); *F04D 13/10* (2013.01);

(Continued)

(58) Field of Classification Search

CPC ..... F04D 13/08; F04D 13/086; F04D 13/10; F04D 25/0686; F04D 29/2216; F04D 29/242

(Continued)

(56) References Cited

U.S. PATENT DOCUMENTS 1,959,703 A * 5/1934 Birmann ..... 416/183
3,265,001 A * 8/1966 Deters ..... F04D 13/10 415/141

(Continued)

OTHER PUBLICATIONS

Yun, Y. I. et al., "Investigation of 3D Unsteady Flows in a Two-Stage Shrouded Axial Turbine Using Stereoscopic PIV and FRAP—Part II: Kinematics of Shroud Cavity Flow," Paper at Proceedings of ASME Turbo Expo 2006 Power for Land, Sea and Air, May 8-11, 2006, 10 pages, Barcelona, Spain.

(Continued)

*Primary Examiner* — Sean J Younger

(74) *Attorney, Agent, or Firm* — Frederic Dorwart, Lawyers PLLC; Penina Michlin Chiu

(57) ABSTRACT

An apparatus, system and method for pumping gaseous fluid are described. The centrifugal pump of the invention homogenizes at least a portion of the gas and liquid contained in produced well fluid thereby improving the efficiency of the pump in electric submersible pump (ESP) applications and decreasing the downtime of the ESP system. The impeller of the invention comprises an increased inlet area. The centrifugal pump of the invention comprises a single shroud located on the bottom side of an impeller, an increased inlet area of the impeller and an increased clearance gap between the impeller and a diffuser. One or more truncated vanes extend substantially upstream from the single shroud, wherein each truncated vane sits at a mid-pitch location between untruncated vanes starting from the bottom side of the impeller.

15 Claims, 8 Drawing Sheets

Related U.S. Application Data

(60) Provisional application No. 61/675,578, filed on Jul. 25, 2012.

(51) Int. Cl.

| | |
|---|---|
| ***F04D 29/18*** | (2006.01) |
| ***F04D 1/00*** | (2006.01) |
| ***F04D 29/22*** | (2006.01) |
| ***F04D 31/00*** | (2006.01) |
| ***F04D 1/04*** | (2006.01) |

(52) U.S. Cl.
CPC ..... *F04D 29/2238* (2013.01); *F04D 31/00* (2013.01)

(58) Field of Classification Search
USPC ..... 415/199.2; 416/180, 203, 223 B
See application file for complete search history.

(56) References Cited

U.S. PATENT DOCUMENTS

| | | | | |
|---|---|---|---|---|
| 3,424,372 | A | 1/1969 | Blattner et al. | |
| 3,951,565 | A * | 4/1976 | Rothe et al. | 415/1 |
| 4,093,401 | A * | 6/1978 | Gravelle | 416/185 |
| 4,149,825 | A * | 4/1979 | Grennan | 415/11 |
| 4,275,988 | A * | 6/1981 | Kalashnikov et al. | 415/74 |
| 5,002,461 | A * | 3/1991 | Young et al. | 416/183 |
| 5,628,616 | A * | 5/1997 | Lee | 415/58.2 |
| 5,639,217 | A * | 6/1997 | Ohtsuki et al. | 416/183 |
| 6,106,224 | A * | 8/2000 | Sheth | F04D 29/0413 415/104 |
| 6,312,216 | B1 * | 11/2001 | Falcimaigne | 415/74 |
| 6,508,626 | B1 * | 1/2003 | Sakurai et al. | 416/180 |
| 6,676,366 | B2 | 1/2004 | Kao | |
| 7,094,016 | B1 * | 8/2006 | Zaher | 415/1 |
| 7,179,050 | B2 * | 2/2007 | Hopfensperger | 415/204 |
| 7,549,837 | B2 | 6/2009 | Hackworth et al. | |
| 8,162,600 | B2 * | 4/2012 | Brown et al. | 415/199.2 |
| 2010/0319926 | A1 * | 12/2010 | Reid | 166/372 |
| 2011/0173975 | A1 * | 7/2011 | Sun et al. | 60/605.2 |
| 2014/0050570 | A1 | 2/2014 | Jayaram et al. | |

OTHER PUBLICATIONS

Madhwesh, N. K. et al., "Impeller Treatment for a Centrifugal Fan using Splitter Vanes—A CFD Approach," Paper at Proceedings of the World Congress on Engineering 2011 vol. III, Jul. 6-8, 2011, 6 pages, London, England.

Wikipedia, "Airfoil," taken from https://en.wikipedia.org/wiki/Airfoil, Post Date Unknown, 9 pages.

* cited by examiner

APPARATUS, SYSTEM AND METHOD FOR PUMPING GASEOUS FLUID

CROSS REFERENCE TO RELATED APPLICATIONS

The present application is a continuation of application Ser. No. 13/801,969 to Jayaram et al., filed Mar. 13, 2013 and entitled APPARATUS, SYSTEM AND METHOD FOR PUMPING GASEOUS FLUID, which claims the benefit of U.S. Provisional Application No. 61/675,578 to Jayaram et al., filed Jul. 25, 2012 and entitled "APPARATUS, SYSTEM AND METHOD FOR PUMPING GASEOUS FLUID," each of which are hereby incorporated by reference in their entireties.

BACKGROUND OF THE INVENTION

1. Field of the Invention

Embodiments of the invention described herein pertain to the field of electric submersible pumps. More particularly, but not by way of limitation, one or more embodiments of the invention enable an apparatus, system and method for pumping gaseous fluid in electric submersible pump downhole applications.

2. Description of the Related Art

Fluid, such as gas, oil or water, is often located in underground formations. In such situations, the fluid must be pumped to the surface so that it can be collected, separated, refined, distributed and/or sold. Centrifugal pumps are typically used in electric submersible pump applications for lifting well fluid to the surface. Centrifugal pumps impart energy to a fluid by accelerating the fluid through a rotating impeller paired with a stationary diffuser. The rotation confers angular momentum to the fluid passing through the pump. The angular momentum converts kinetic energy into pressure, thereby raising the pressure on the fluid and lifting it to the surface. Multiple stages of impeller and diffuser pairs may be used to further increase the pressure.

Conventional centrifugal pumps are designed to handle fluid consisting mainly of liquids. However well fluid often contains gas in addition to liquid. Currently available submersible pump systems are not appropriate for pumping fluid with a high gas to liquid ratio. Particularly, submersible pump systems need to be better suited to manage gas contained in well fluid. When pumping gas laden fluid, the gas may separate from the other fluid due to the pressure differential created when the pump is in operation. If there is a sufficiently high gas volume fraction, typically around 10% to 15%, the pump may experience a decrease in efficiency and decrease in capacity or head (slipping). If gas continues to accumulate on the suction side of the impeller it may entirely block the passage of other fluid through the impeller. When this occurs the pump is said to be "gas locked" since proper operation of the pump is impeded by the accumulation of gas. As a result, careful attention to gas management in submersible pump systems is needed in order to improve the production of gas laden fluid from subsurface formations.

A typical impeller of a centrifugal pump is shown in FIGS. 1A and 1B. In FIG. 1A, closed impeller 100 is shown with six evenly spaced conventional vanes 105. For illustration purposes only, upper conventional shroud 110 and lower conventional shroud 115 are shown in FIG. 1B, but are not shown in FIG. 1A. FIG. 1B shows a cross sectional view of closed impeller 100 with two conventional shrouds, upper conventional shroud 110 and lower conventional shroud 115. In FIG. 1B, conventional hub 125 is long and hollow and connected to lower conventional shroud 115, upper conventional shroud 110 and conventional vanes 105. Conventional hub 125 slides over conventional shaft 130 and is keyed to conventional shaft 130, which causes closed impeller 100 to rotate with conventional shaft 130. Closed impeller 100 rotates counterclockwise or clockwise with shaft 130. Apertures 120 (shown in FIG. 1A) balance the pressure on each side of closed impeller 100. Conventional closed impeller 100 has a suction specific speed of about 6000.

Closed impeller 100 is paired with a conventional stationary diffuser, such as that shown in FIG. 2, such that each impeller rotates within (inward of) the diffuser to which it is paired. The diffuser does not rotate, but is mounted coaxially with the impeller and nests on the diffuser of the previous stage. Typically there is a clearance gap between the diffuser and impeller to which it is paired. This conventional clearance gap is typically about 0.015 inches to about 0.02 inches in width for conventional semi-open impellers.

Currently, gas separators are sometimes used in an attempt to address the problems caused by gas in produced fluid. Gas separators attempt to remove gas from produced fluid prior to the fluid's entry into the pump. However it is often infeasible, costly or too time consuming to ascertain the correct type of pump and separator combination which might be effective for a particular well, and even if the correct arrangement is ascertained, the separator may not remove enough gas to prevent a loss in efficiency and/or prevent gas locking In the case of an electric submersible pump (ESP), a failure of the pump or any support components in the pump assembly can be catastrophic as it means a delay in well production and having to remove the pump from the well for repairs. A submersible pump system capable of homogenizing produced gaseous fluid would be an advantage in all types of submersible assemblies.

Currently available pump assemblies do not contain components to satisfactorily homogenize gas laden fluid and prevent gas locking This shortcoming decreases the efficiency and overall effectiveness of the pump assembly. Therefore, there is a need for an apparatus, system and method for pumping gaseous fluid in electric submersible pump applications.

BRIEF SUMMARY OF THE INVENTION

One or more embodiments of the invention enable an apparatus, system and method for pumping gaseous fluid.

An apparatus, system and method for pumping gaseous fluid are described. The impeller of an illustrative embodiment comprises an increased inlet area. In some embodiments, the increased inlet area is between about 1.75 and about 2.5 times the size of an inlet area of a conventional impeller. In some embodiments, the impeller comprises a single shroud located on a bottom side of the impeller. In some embodiments, at least two untruncated vanes extend substantially upstream from the single shroud, and at least two truncated vanes extend substantially upstream from the single shroud, wherein each truncated vane sits at a mid-pitch location between untruncated vanes starting from the bottom side of the impeller. In some embodiments, the truncated vanes are between about 50% and about 75% of the chord length of the untruncated vanes. In some embodiments, the single shroud extends radially about a hub. In certain embodiments the suction specific speed of the impeller is between about 8000 to about 12000.

The centrifugal pump of an illustrative embodiment comprises an impeller inward of a diffuser and an increased clearance gap between the impeller and the diffuser, the impeller comprising a top side and a bottom side, wherein the top side is open to the diffuser, and wherein the impeller further comprises a single shroud located on the bottom side of the impeller and arranged radially about a hub, an untruncated vane extending substantially upstream from the single shroud, and a truncated vane extending substantially upstream from the single shroud. In some embodiments there are at least two untruncated vanes, wherein a truncated vane sits at a mid-pitch location between the at least two untruncated vanes starting from the bottom side of the impeller. In certain embodiments, the increased clearance gap is between about 0.060 inches and about 0.180 inches wide.

The method of an illustrative embodiment may include a method for pumping gaseous fluid comprising placing a centrifugal pump into a well containing gaseous fluid, operating the pump to induce the fluid to flow towards the surface of the well, causing at least a portion of the fluid to flow through an increased clearance gap between an impeller and a diffuser, and minimizing phase separation of the fluid by reducing a pressure differential between a pressure side and a suction side of an impeller vane. In some embodiments the phase separation of the fluid is minimized by an impeller with an increased inlet area. In some embodiments, the inlet area is increased by replacing an impeller vane with a truncated vane.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the illustrative embodiments will be more apparent from the following more particular description thereof, presented in conjunction with the following drawings wherein.

Figure 1A:
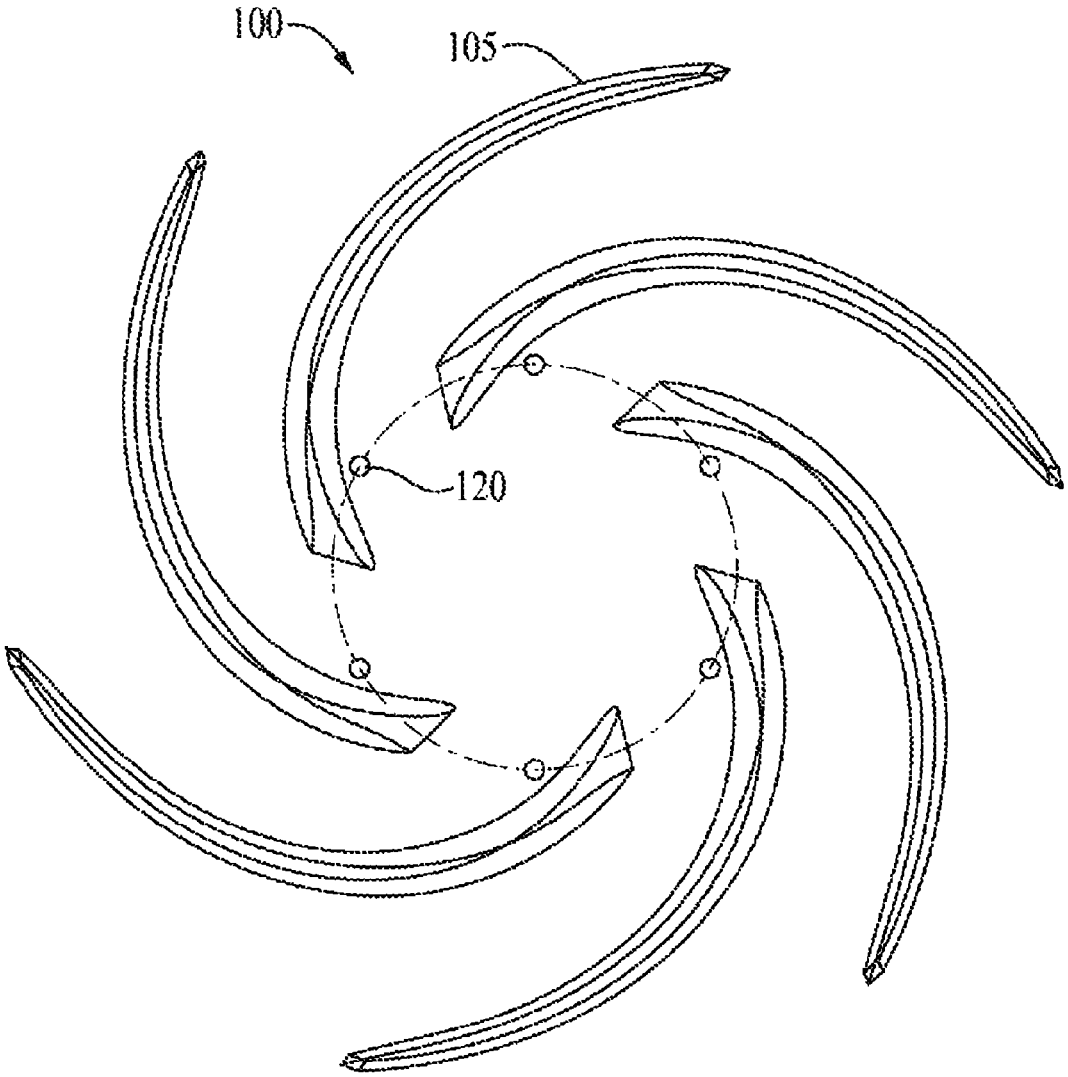
FIG. 1A PRIOR ART
FIG. 1A illustrates a plan view of an impeller of the prior art.
Figure 1B:
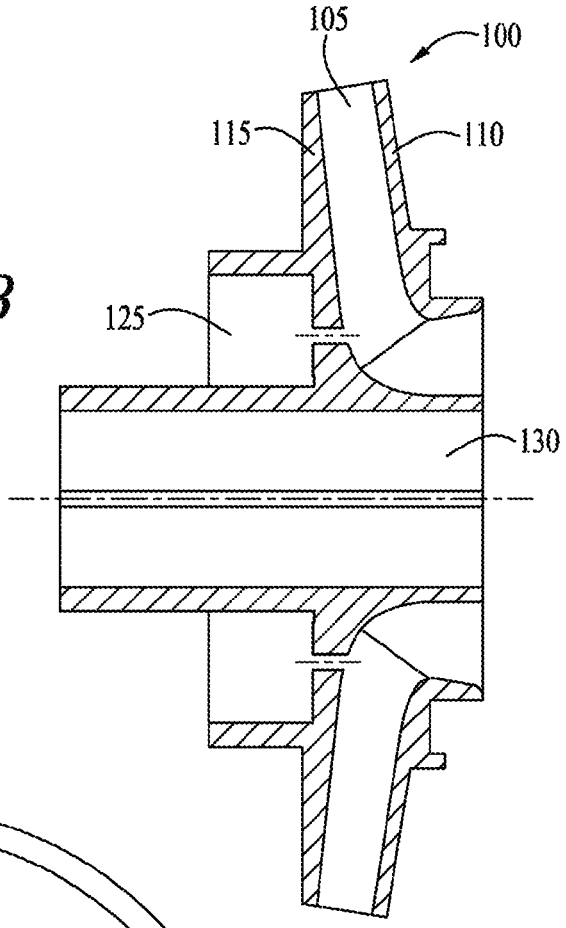
FIG. 1B PRIOR ART
FIG. 1B illustrates a cross sectional view of an impeller of the prior art.
Figure 2:
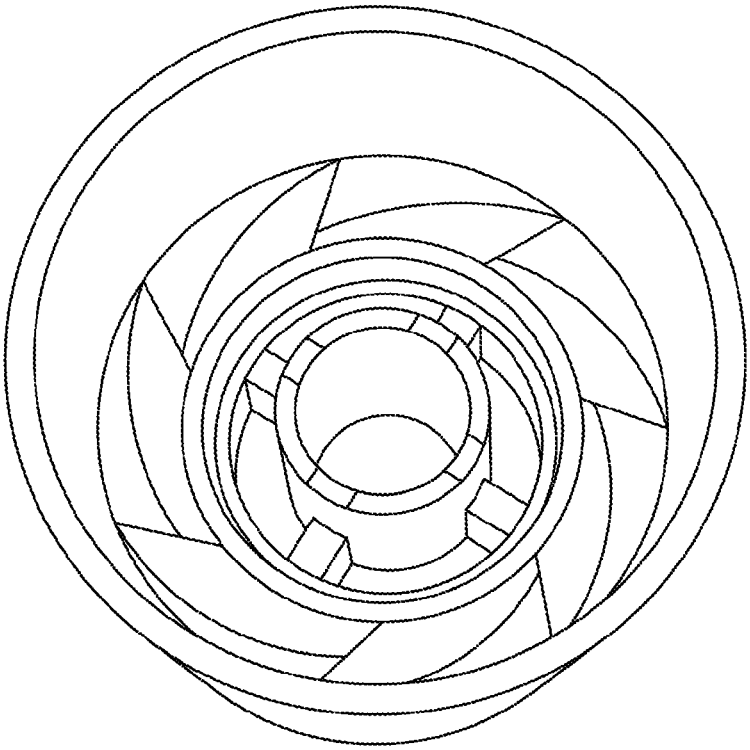
FIG. 2 PRIOR ART
FIG. 2 illustrates a perspective view of a diffuser of the prior art.

While the invention is susceptible to various modifications and alternative forms, specific embodiments thereof are shown by way of example in the drawings and may herein be described in detail. The drawings may not be to scale. It should be understood, however, that the embodiments described herein and depicted in the drawings are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus, system and method for pumping gaseous fluid will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a vane includes one or more vanes.

"Coupled" refers to either a direct connection or an indirect connection (e.g., at least one intervening connection) between one or more objects or components. The phrase "directly attached" means a direct connection between objects or components.

"Bottom" or "lower" side of an impeller refers to the substantially downstream side of an impeller.

"Top" or "upper" side of an impeller refers to the substantially upstream side of an impeller.

"Downstream" refers to the direction substantially with the primary flow of fluid when the centrifugal pump is in operation.

"Upstream" refers to the direction substantially opposite the primary flow of fluid when the centrifugal pump is in operation.

One or more embodiments of the invention provide an apparatus, system and method for pumping gaseous fluid for use in electric submersible pump applications. While the invention is described in terms of an oil or water production embodiment, nothing herein is intended to limit the invention to that embodiment.

The invention disclosed herein includes an apparatus, system and method for pumping gaseous fluid. In some embodiments, after intake into the pump assembly, gas laden fluid may be rotated by a centrifugal pump including a semi-open impeller. In some embodiments, the semi-open impeller includes only a single shroud arranged radially about a hub. In some embodiments, a truncated vane and an untruncated vane, which may be arranged circumferentially about the hub, may extend substantially upstream from the single shroud. In some embodiments, the truncated vane may be located at a mid-pitch location between two untruncated vanes starting from the bottom side of the impeller. In certain embodiments, the impeller may include two, three or four of each truncated and untruncated vanes which alternate around the hub. In some embodiments, the impeller may include an increased inlet area. In some embodiments, there may be an increased clearance gap between the impeller and a diffuser, through which the fluid may flow. The features of the invention may minimize phase separation of the fluid by reducing the pressure differential between the pressure side and suction side of an impeller vane. This may homogenize the liquid and gas in the fluid, increase the efficiency and performance of the pump, prevent gas locking and reduce the producing well's downtime.

In some embodiments, the vanes of the present disclosure are arranged such that there is a larger inlet area of the impeller than in conventional impeller designs. Specifically, the reduction in the number of untruncated vanes and addition of one or more truncated vanes of the present disclosure provide for additional open space in the inlet region of the impeller. The impeller of an illustrative embodiment may have between about 1.75 and 2.5 times the size of the inlet area of a conventional impeller. The additional open space may reduce the velocity of the fluid passing through the impeller, which assists in maintaining high positive pressure at the impeller inlet. The impeller of the present disclosure is capable of operating with higher suction specific speed as compared to conventional impellers. In some embodiments, the impeller of the present disclosure may operate at about 8000 to about 12000 suction specific speed.

Figure 3:
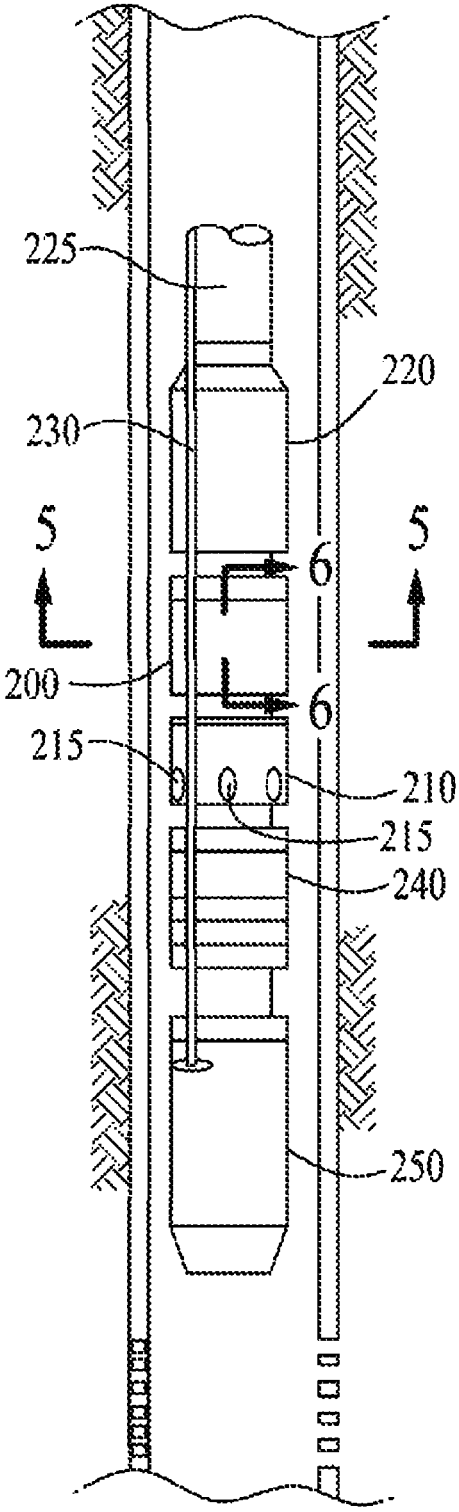
FIG. 3 illustrates one embodiment of an exemplary electric submersible pump (ESP) system.

The invention includes a centrifugal pump for electric submersible pump (ESP) systems. FIG. 3 illustrates one embodiment of an exemplary ESP assembly for use in the system of the invention. This assembly may be located in an underground well during operation. In FIG. 3, the centrifugal pump of an illustrative embodiment comprises ESP charge pump 200, which is located downstream of ESP intake 210. As shown in FIG. 3, fluid enters the ESP assembly through fluid intakes 215 on ESP intake 210. ESP charge pump 200 may homogenize fluid prior to the fluid entering ESP primary pump 220.

In some embodiments, a gas separator (not shown) may be located between ESP intake 210 and ESP charge pump 200 to reduce the gas content of the fluid prior to the fluid entering ESP primary pump 220. When used, the gas separator may be the intake surface for the ESP pump system. In certain embodiments, the centrifugal pump of the present disclosure eliminates the need for a gas separator. In some embodiments, the centrifugal pump of an illustrative embodiment may be used in conjunction with a gas separator.

ESP primary pump 220 and production tubing string 225 are downstream of ESP charge pump 200. In some embodiments, motor lead extension 230 may plug into ESP motor 250 at one end and may be spliced to another larger cable than runs the length of the well bore to a junction box and/or a control panel on the surface of the well site. Production tubing string 225 may be a conduit for the produced well fluid to flow from the reservoir towards the surface. ESP seal 240 sits between ESP motor 250 and ESP intake 210 and may protect ESP motor 250 from well fluid.

Figure 4A:
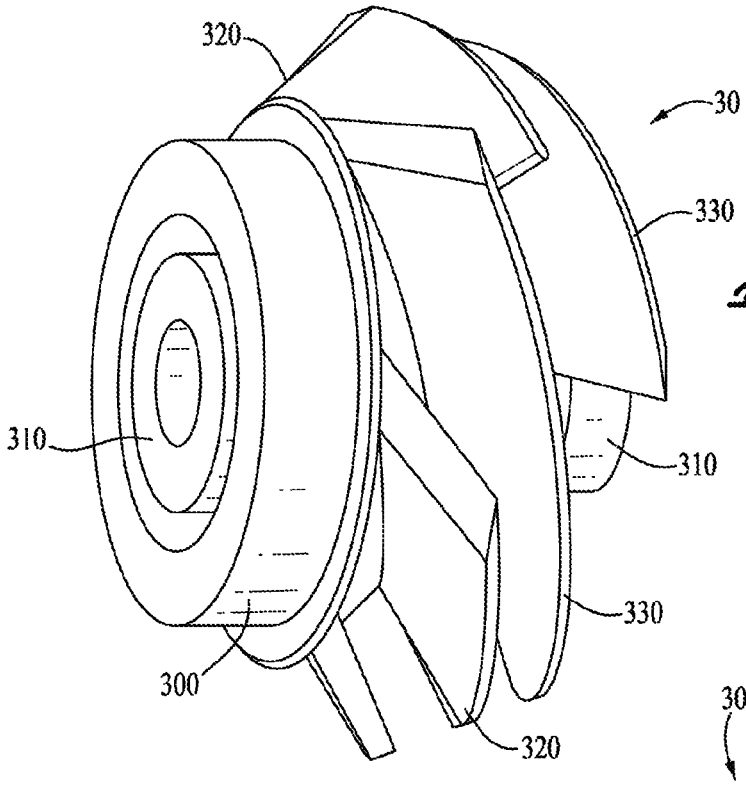
FIG. 4A illustrates a perspective view of one embodiment of a semi-open impeller.
Figure 4B:
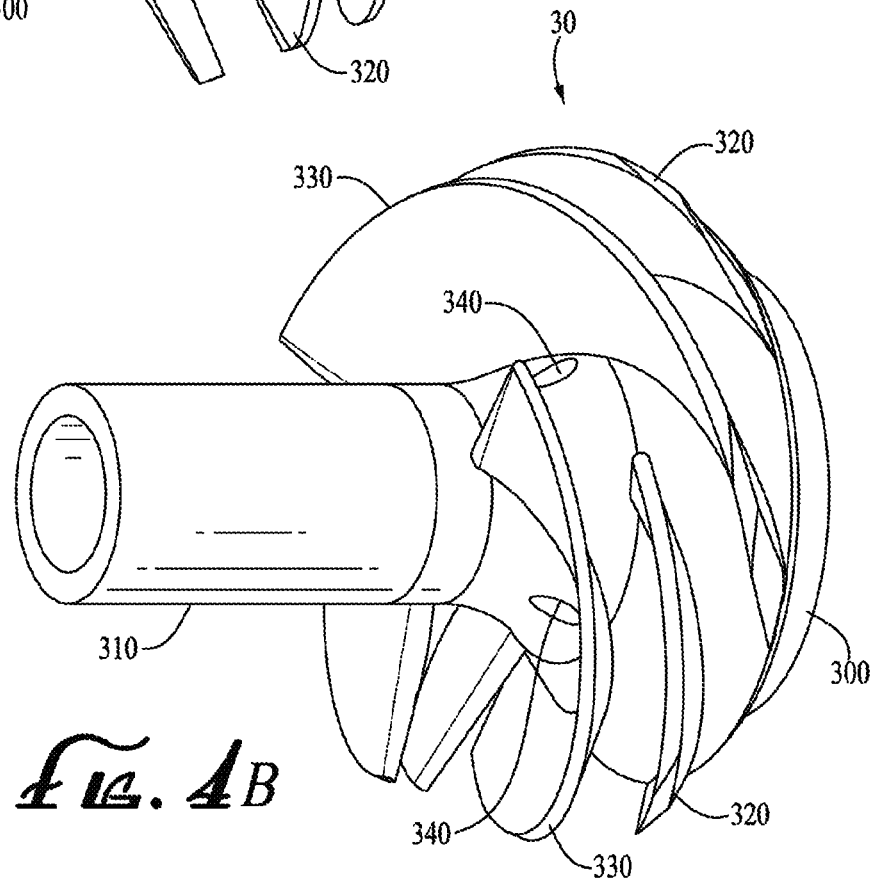
FIG. 4B illustrates a perspective view of one embodiment of a semi-open impeller.

FIGS. 4A and 4B illustrate perspective views of one exemplary embodiment of a semi-open impeller of an illustrative embodiment. Impeller 30 may include single shroud 300 arranged radially about hub 310. Truncated vane 320 and untruncated vane 330 may extend substantially upstream from single shroud 300. In some embodiments, truncated vane 320 sits at a mid-pitch location between two untruncated vane 330 starting from the bottom side of impeller 30. In certain embodiments, truncated vane 320 alternates with untruncated vane 330, which vanes 320, 330 are circumferentially disposed about hub 310. In some embodiments there are two, three or four of each truncated vane 320 and untruncated vane 330 disposed about hub 310. Greater or fewer number of vanes 320, 330 may also be used. In certain embodiments, the number of truncated vane 320 varies from the number of untruncated vane 330 and/or the vanes 320, 330 may not strictly alternate. In FIG. 4B, balance holes 340 are also shown on impeller 30 and assist in equalizing the pressure on each side of impeller 30. In some embodiments, impeller 30 may operate at about 8000 to about 12000 suction specific speed. In some embodiments, truncated vane 320 may increase the performance of a pump's head flow and efficiency and maintain high net positive suction pressure, without sacrificing suction performance.

Figure 5:
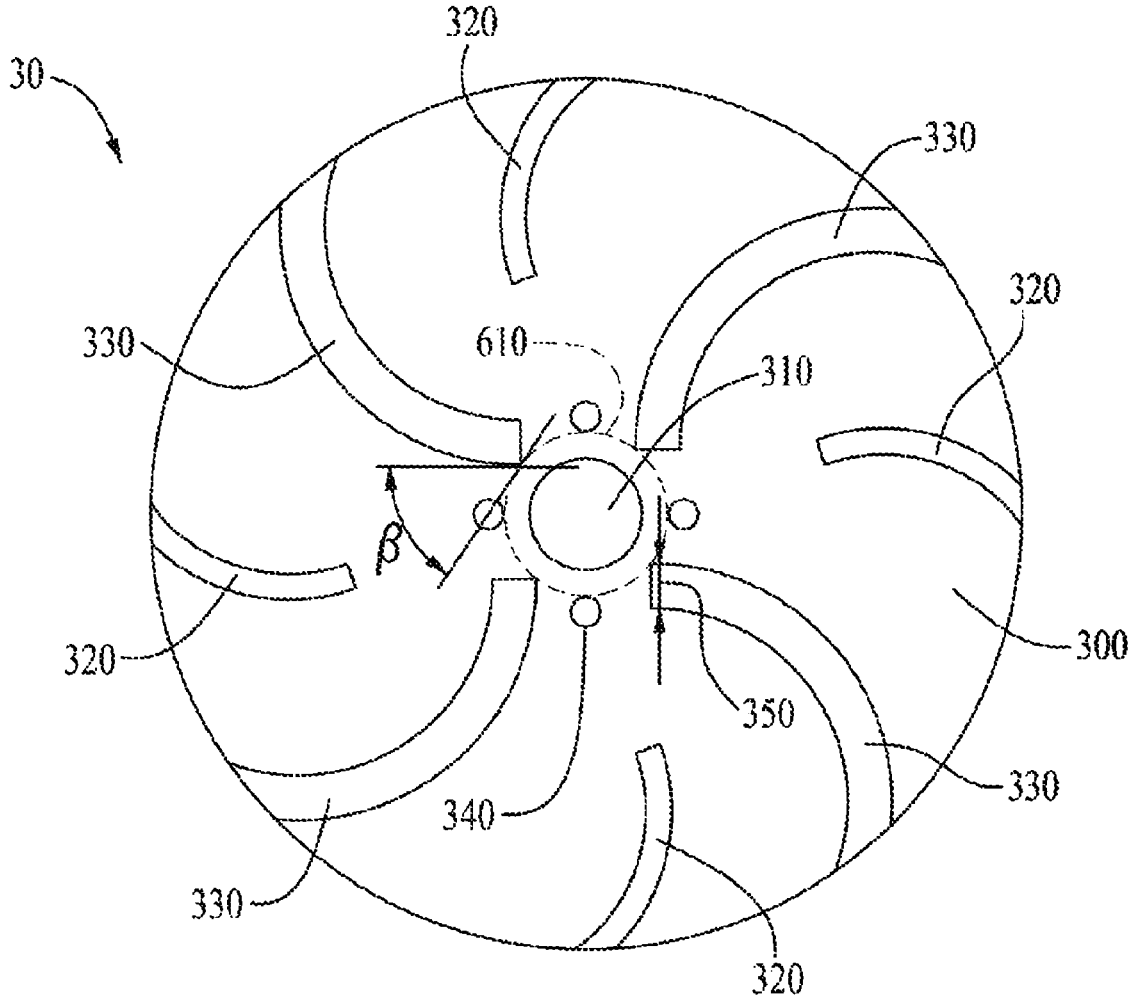
FIG. 5 is a partial cross sectional view taken along line 5-5 of FIG. 3 of one embodiment of an impeller.

FIG. 5 is a partial cross sectional view taken along line 5-5 of FIG. 3 of one illustrative embodiment of an impeller for a centrifugal pump. FIG. 5 illustrates one embodiment of single shroud 300 and the arrangement of vanes 320, 330 disposed about hub 310 of impeller 30. In some embodiments, truncated vane 320 is between about 50% and 75% the chord length of untruncated vane 330 (as judged from hub 310 and extending from the outer circumference of single shroud 300). In certain embodiments, truncated vane 320 may be shorter or longer but always shorter in chord length than untruncated vane 330. In some embodiments, a centrifugal pump of an illustrative embodiment may include abrasion resistant trim, such as busing 560 and flanged sleeve 570 (shown in FIG. 6) to increase the lifespan of the centrifugal pump in the instance that solids are also present in the produced well fluid.

In some embodiments the arrangement of vanes 320, 330 create inlet area 610 of impeller 30 between about 1.75 and about 2.5 times the size of the inlet area of a conventional impeller. One embodiment of inlet area 610 is illustrated in FIG. 6A. As shown in FIG. 6A, the size of inlet area 610 may be calculated using the formula:

$$\text{Inlet Area}=2\pi RH-B$$

where R is mean inlet radius 620 as measured from centerline 640, H is inlet vane height 630 and B is the vane blockage. The vane blockage may be calculated as follows:

$$\text{Vane Blockage} = NH\frac{T}{\sin\beta}$$

where N is the number of untruncated vane 330 in impeller 30, H is inlet vane height 630, T is vane thickness 350 (shown in FIGS. 5) and β is the inlet vane angle (shown in FIG. 5).

As truncated vane 320 do not contribute to vane blockage, the arrangement of vanes 320, 330 of an illustrative embodiment reduce the vane blockage and thereby increase inlet area 610.

Figure 6:
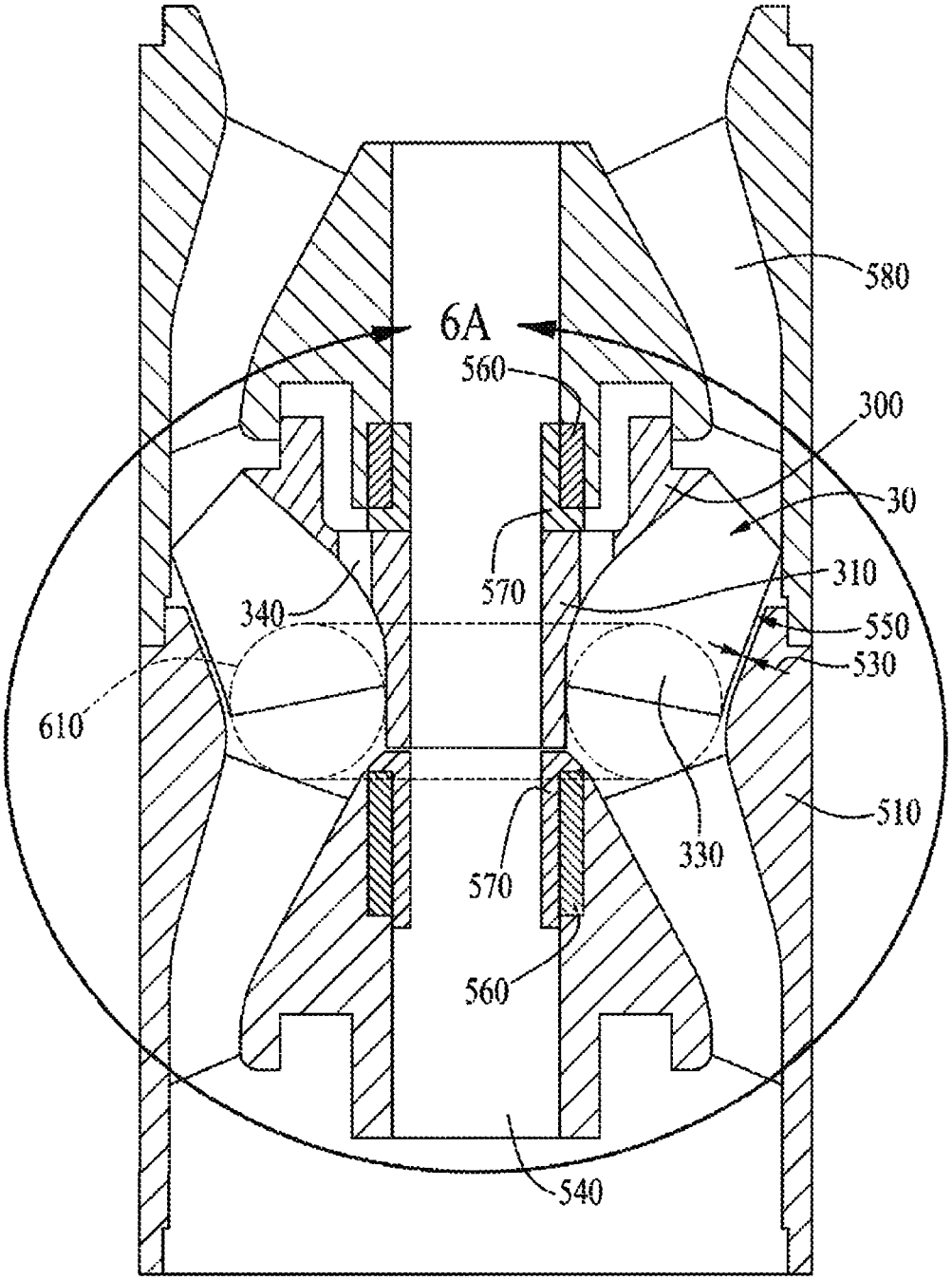
FIG. 6 is a cross sectional view taken along line 6-6 of FIG. 3 of one embodiment of a centrifugal pump.
Figure 6A:
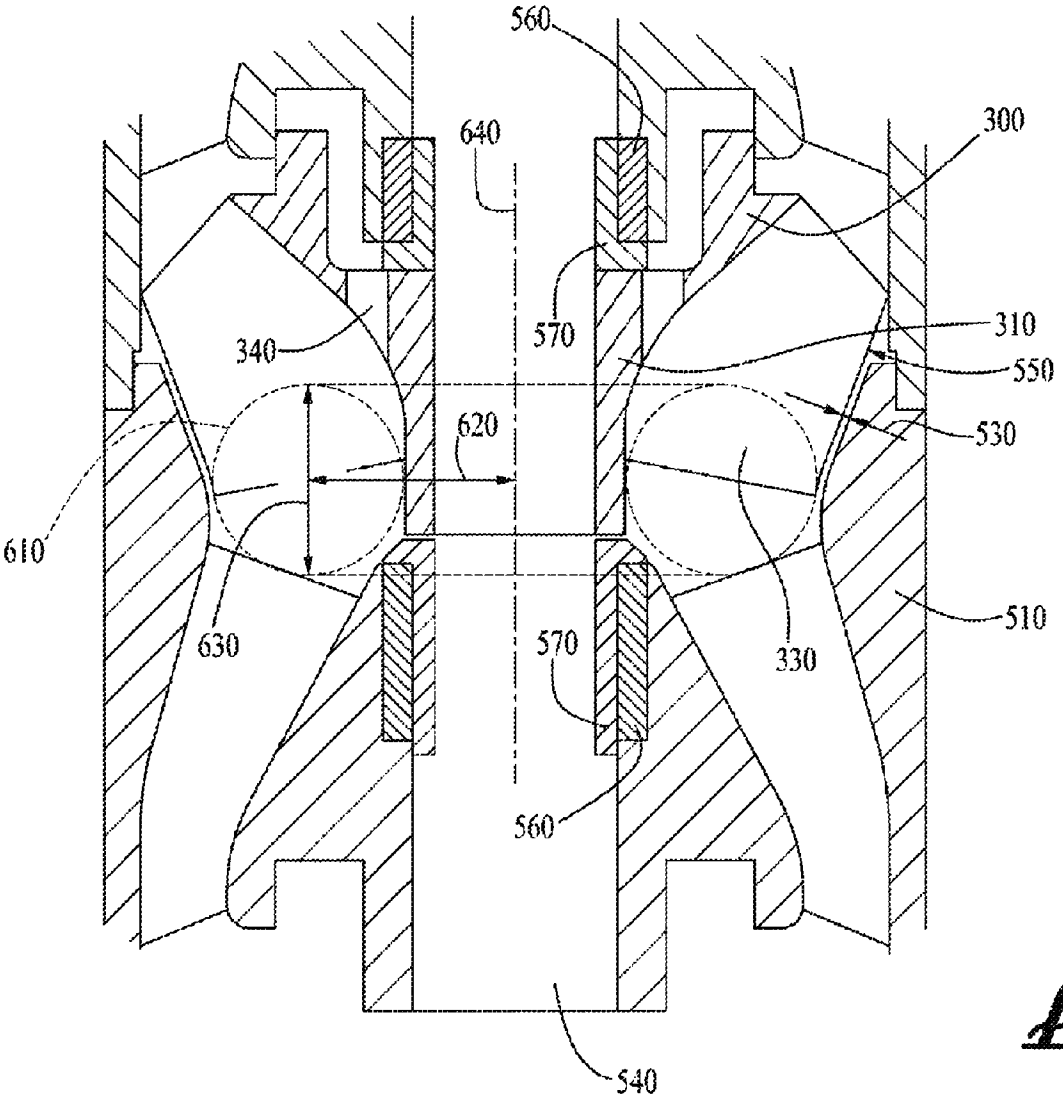
FIG. 6A is an enlarged view of one embodiment of the inlet area of a centrifugal pump.

FIG. 6 is a cross sectional view taken along line 6-6 of FIG. 3 of one embodiment of a centrifugal pump of an illustrative embodiment. Impeller 30 may be keyed to shaft 540 at hub 310, such that impeller 30 rotates with shaft 540. Impeller 30 is paired with diffuser 510. FIGS. 6, 6A show untruncated vane 330 for illustration purposes, but truncated vane 320 may also be included in impeller 30 in addition to or instead of untruncated vane 330, for example as shown in FIGS. 4A, 4B and/or FIG. 5. In some embodiments, no shroud is present on top side 550 of impeller 30. Single shroud 300 is located on the bottom side of impeller 30.

Gap 530 is between untruncated vane 330 and/or truncated vane 320 (shown in FIG. 5) of impeller 30 and diffuser 510. In some embodiments, gap 530 is an increased clearance gap. The width of gap 530 may be increased by machining the face of diffuser 510 that sits parallel to the face of impeller 30. In some embodiments, increased clearance gap 530 is between about 0.060 inches and about 0.180 inches wide, as required for various gas to liquid ratios. In certain embodiments, increased clearance gap 530 may be wider or narrower depending on the size of the pump and type of well and/or fluid being pumped. In some embodiments, increased clearance gap 530 is at least wider than about 0.020 inches. Increased clearance gap 530 allows the high pressure fluid to circulate and mix with low pressure fluid. Balance holes 340 assist in equalizing the pressure on each side of impeller 30.

In some embodiments, bushing 560 and flanged sleeve 570 located upstream and/or downstream of hub 310 assist in stabilizing impeller 30 and/or holding impeller 30 in place during operation. In some embodiments, bushing 560 and flanged sleeve 570 are located directly upstream and downstream of hub 310. Bushing 560 and/or flanged sleeve 570 may assist in carrying at least a portion of the axial thrust load on impeller 30, such as upthrust and/or downthrust. Bushing 560 and/or flanged sleeve 570 may be made of tungsten carbide, silicon carbide or any other material having similar properties. In some embodiments, bushing 560 and flanged sleeve 570 comprise abrasion resistant trim.

As shown in FIG. 6, when impeller 30 is in operation, fluid may flow downstream and/or upwards through passage 580 towards successive stages of impeller 30 and diffuser 510 pairs and then to ESP primary pump 220, eventually passing through production tubing 225 to a pipe, conduit, tank, collection container or other desired location.

In some embodiments, ESP charge pump 200 comprises multiple stages of impeller 30 and diffuser 510 pairs, which are stacked on shaft 540. In certain embodiments, ESP charge pump 200 includes between about 10 and about 100 stages of impeller 30 and diffuser 510 pairs. In some embodiments, impeller 30 may be employed in ESP primary pump 220.

Figure 7:
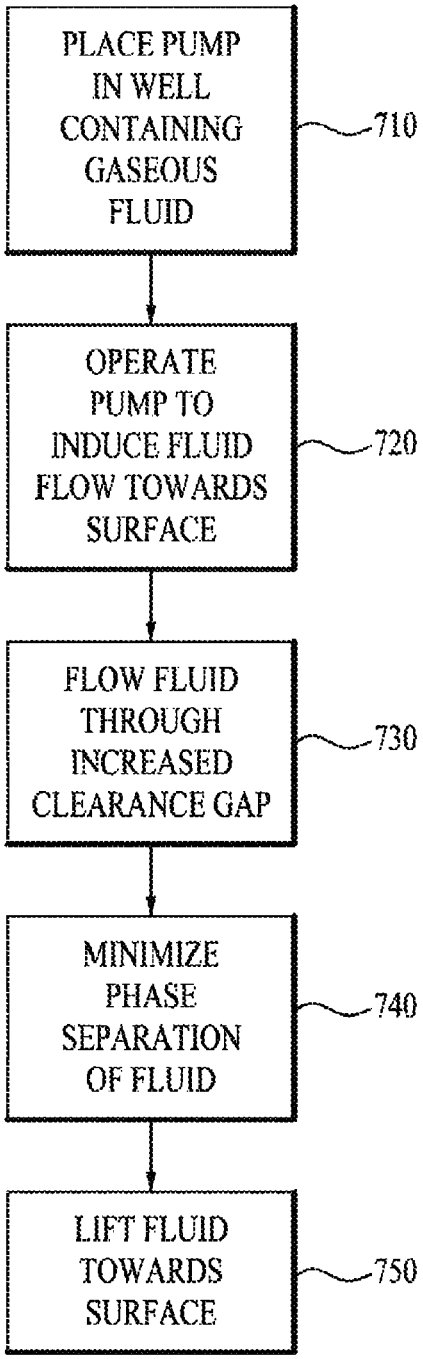
FIG. 7 is a flow chart illustrating an exemplary method of pumping gaseous fluid.

FIG. 7 is a flow chart illustrating an exemplary method of pumping gaseous fluid of an illustrative embodiment. At step 710 a centrifugal pump, such as ESP primary pump 220 and/or ESP charge pump 200, is placed into a well containing gaseous fluid. The pump may then be operated to induce the fluid to flow towards the surface of the well at step 720. At least a portion of the fluid may flow through increased clearance gap 530 between truncated vane 320 and/or untruncated vane 330, and a diffuser 510, at step 730. At step 740, phase separation of the fluid may be minimized by reducing the pressure differential between the pressure side and suction side of truncated vane 320 and/or untruncated vane 330. In some embodiments, the fluid flow may be caused by rotating an impeller comprising truncated vane 320 and at least two untruncated vane 330 extending substantially upstream from a single shroud 300, wherein a truncated vane 320 sits at a mid-pitch location between untruncated vane 330 starting from the bottom side of impeller 30. In some embodiments, the pressure differential between the pressure side and suction side of truncated vane 320 and/or untruncated vane 330 may be reduced by increasing impeller inlet area 610. Fluid may then be lifted towards the surface, a transport conduit, pipe, tank, collection container, or any other desired location at step 750.

The centrifugal pump of the invention may be suitable for a variety of types of submersible stages known in the art for use in submersible pumps. For example, mixed flow submersible pump stages, as well as radial flow submersible pump stages, may make use of the centrifugal pump of the invention. Both these and other submersible stages suitable for use with an ESP system may benefit from the centrifugal pump of the present disclosure.

Various embodiments of the invention may comprise various numbers and spacing of truncated vane 320. ESP primary pump 220 and/or ESP charge pump 200 may benefit from the centrifugal pump of the invention. One or more pump stages within ESP primary pump 220 and/or ESP charge pump 200 may benefit from the centrifugal pump of the invention. In some embodiments the invention described herein may be suitable for pumping fluid having a gas to liquid ratio of up to about 50% by volume. The impeller of the invention may have between about 1.75 and 2.5 times the size of the inlet area of a convention impeller. In some embodiments, the impeller of the invention may operate at about 8000 to about 12000 suction specific speed.

While the invention herein disclosed has been described by means of specific embodiments and applications thereof, numerous modifications and variations could be made thereto by those skilled in the art without departing from the scope of the invention set forth in the claims. The embodiments described in the foregoing description are therefore considered in all respects to be illustrative and not restrictive. The scope of the invention is indicated by the appended claims, and all changes that come within the meaning and range of equivalents thereof are intended to be embraced therein.

What is claimed is:

1. An electric submersible pump (ESP) assembly comprising:

a single shroud coupled to a bottom side of an impeller, wherein a top side of the impeller is open to a diffuser with a fluid homogenizing clearance gap between the impeller and the diffuser between about 0.060 inches and about 0.180 inches wide;

at least two untruncated vanes extending substantially upstream from the single shroud and helically along an axially extending hub of the impeller, wherein each of the at least two untruncated vanes has an untruncated vane chord length;

at least two truncated vanes extending substantially upstream from the single shroud and helically along the axially extending hub of the impeller, wherein each truncated vane sits at a mid-pitch location between two of the at least two untruncated vanes; and wherein the at least two truncated vanes extend from an outer circumference of the single shroud and each truncated vane has a truncated vane chord length greater than 50% and less than about 75% of the untruncated vane chord length as measured from the axially extending hub of the impeller.

2. The ESP assembly of claim 1, wherein there are three truncated vanes and three untruncated vanes.

3. The ESP assembly of claim 1, wherein there are two truncated vanes and two untruncated vanes.

4. The ESP assembly of claim 1, wherein there are four truncated vanes and four untruncated vanes.

5. The ESP assembly of claim 1, wherein the single shroud extends radially about the axially extending hub of the impeller.

6. The ESP assembly of claim 1, wherein the single shroud extends radially about the axially extending hub of the impeller, and wherein the axially extending hub of the impeller is keyed to a shaft of an ESP charge pump.

7. The ESP assembly of claim 1, wherein the single shroud extends radially about the axially extending hub of the impeller, and wherein the axially extending hub of the impeller is keyed to a shaft of an ESP primary pump.

8. The ESP assembly of claim 1, wherein the impeller operates at about 8000 to about 12000 suction specific speed.

9. The ESP assembly of claim 1, further comprising:

a first bushing and a first flanged sleeve located directly upstream of the axially extending hub; and a second bushing and a second flanged sleeve located directly downstream of the axially extending hub.

10. An electric submersible pump (ESP) assembly comprising:

an impeller inward of a diffuser, wherein the impeller comprises a top side and a bottom side, wherein the top side is open to the diffuser, and wherein the impeller further comprises:

an axially extending hub;

a single shroud coupled to the bottom side of the impeller and arranged radially about the axially extending hub;

at least two untruncated vanes extending helically along the axially extending hub and substantially upstream from the single shroud;

a truncated vane extending helically along the axially extending hub and substantially upstream from the single shroud, wherein the truncated vane extends from an outer circumference of the single shroud and has a truncated vane chord length greater than 50% and less than about 75% of a chord length of one of the at least two untruncated vanes as measured from the axially extending hub;

a fluid homogenizing clearance gap between the impeller and the diffuser between about 0.060 inches and about 0.180 inches wide; and wherein the truncated vane sits at a mid-pitch location between two of the at least two untruncated vanes.

11. The ESP assembly of claim 10, wherein there are four truncated vanes and four untruncated vanes, wherein truncated vanes alternate with untruncated vanes around the axially extending hub, and wherein each truncated vane sits at a mid-pitch location throughout its length between two untruncated vanes.

12. The ESP assembly of claim 10, further comprising:

a first bushing and a first flanged sleeve located directly upstream of the axially extending hub; and a second bushing and a second flanged sleeve located directly downstream of the axially extending hub.

13. An improved system for pumping gaseous fluids from a well employing an electric submersible pump (ESP), the system comprising:

an ESP assembly comprising:

an impeller inward of a diffuser, wherein the impeller comprises a top side and a bottom side, wherein the top side is open to the diffuser with a fluid homogenizing clearance gap between the impeller and the diffuser between about 0.060 inches and about 0.180 inches wide, and wherein the impeller further comprises:

an axially extending hub;

a single shroud located on the bottom side of the impeller and arranged radially about the hub;

at least two untruncated vanes extending helically along the axially extending hub substantially upstream from the single shroud;

at least two truncated vanes extending helically along the axially extending hub substantially upstream from the single shroud;

wherein the ESP assembly is placed into a well containing gaseous fluid and operated such that at least a portion of a liquid and a gas in the gaseous fluid are homogenized; and wherein each of the at least two truncated vanes sits at a mid-pitch location between two of the at least two untruncated vanes.

14. The system of claim 13, wherein the truncated vane extends from an outer circumference of the single shroud and is greater than 50% and less than about 75% of a chord length of the untruncated vane as measured from the axially extending hub.

15. The system of claim 13, further comprising:

a first bushing and a first flanged sleeve located directly upstream of the axially extending hub; and a second bushing and a second flanged sleeve located directly downstream of the axially extending hub.

* * * * *